US006259376B1

(12) United States Patent
Fuyama

(10) Patent No.: US 6,259,376 B1
(45) Date of Patent: Jul. 10, 2001

(54) TOLLING APPARATUS

(75) Inventor: Seiji Fuyama, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/371,047

(22) Filed: Aug. 10, 1999

(30) Foreign Application Priority Data

Feb. 10, 1999 (JP) ..... 11-033340

(51) Int. Cl.[7] ..... G08G 1/065
(52) U.S. Cl. ..... 340/928; 340/933; 235/384
(58) Field of Search ..... 340/928, 933, 340/938; 235/384

(56) References Cited

U.S. PATENT DOCUMENTS

| | | | | |
|---|---|---|---|---|
| 5,101,200 | * | 3/1992 | Swett | 340/937 |
| 5,278,563 | * | 1/1994 | Spiess | 342/44 |
| 5,310,999 | * | 5/1994 | Claus et al. | 235/384 |
| 5,546,188 | * | 8/1996 | Wangler et al. | 356/376 |
| 5,717,390 | * | 2/1998 | Hasselbring | 340/933 |
| 5,729,722 | * | 3/1998 | Matsumoto | 713/601 |
| 6,019,525 | * | 2/2000 | Norris | 396/583 |
| 6,045,785 | * | 4/2000 | Wachter et al. | 424/65 |

FOREIGN PATENT DOCUMENTS

| | | |
|---|---|---|
| 9-185737 | 7/1997 | (JP) . |
| 9-245207 | 9/1997 | (JP) . |
| 9-326057 | 12/1997 | (JP) . |
| 10-97656 | 4/1998 | (JP) . |
| 10-261120 | 9/1998 | (JP) . |
| 11-66362 | 3/1999 | (JP) . |

* cited by examiner

*Primary Examiner*—Edward Lefkowitz
(74) *Attorney, Agent, or Firm*—Connolly Bove Lodge & Hutz

(57) ABSTRACT

In a tolling apparatus including first and second vehicle sensors successively arranged along a lane of a toll way, and a communication unit having a communication area on the lane arranged to substantially correspond to an area on the lane between the first and second sensor for communicating with a communication unit on the vehicle to establish a communication link with the communication unit, a microprocessor judges a vehicle as a fair vehicle if the communication link is established during an interval between when the first sensor detects the vehicle and when the second sensor detects the vehicle and if the communication link is established during the predetermined interval to prevent more than one vehicle from establishing the communication link. The second interval may be between when the first sensor detects the vehicle and when the first sensor detects that the vehicle has just passed through the first sensor after the predetermined interval or may be between when the first sensor detects the vehicle and when the first sensor detects another vehicle following the vehicle. A third sensor between first and second sensor may be provided for a judge timing of estblishment of the communication link.

10 Claims, 10 Drawing Sheets

TOLLING APPARATUS

BACKGROUND OF THE INVENTION

1. Field of the Invention

This invention relates to a tolling apparatus for judging whether the travelling vehicle is fair vehicle or unfair vehicle with a radio wave communication.

2. Description of the Prior Art

A tolling apparatus for judging whether the travelling vehicle is a fair (ETC, Electronic Toll Collection) vehicle or an unfair (non-ETC) vehicle with a radio wave communication is known. Japanese patent application provisional publication No. 9-326057 discloses such a tolling apparatus having a transmitting and receiving antenna, first and second sensors are arranged at a specific interval in a communication area of the antenna to start and stops communication with the vehicle.

SUMMARY OF THE INVENTION

The aim of the present invention is to provide a superior tolling apparatus.

According to the present invention there is provided a first tolling apparatus which includes: a first sensor arranged at a first position along a lane for detecting a vehicle passing the first sensor on the lane in a direction of the lane; a second sensor arranged at a second position apart from the first sensor by a predetermined distance in the direction for detecting the vehicle passing the second sensor on the lane; a communicating portion having a communication area on the lane arranged to substantially correspond to an area on the lane between the first and second sensors for communicating with a communication unit on the vehicle in response to the first sensor to establish a communication link with the communication unit; a timer for measuring a predetermined interval in response to the first sensor; a microprocessor responsive to the timer, the first and second sensors, and the communicating portion for judging the vehicle as a fair vehicle if the communication link is established during an interval between when the first sensor detects the vehicle and when the second sensor detects the vehicle and if the communication link is established during the predetermined interval and as an unfair vehicle if the communication link is not established during the interval and if the communication link is not established during the predetermined interval and outputting the judging result.

According to the present invention there is provided a second tolling apparatus which includes: a first sensor arranged at a first position along a lane for detecting a vehicle passing the first sensor on the lane in a direction of the lane; a second sensor arranged at a second position apart from the first sensor by a predetermined distance in the direction for detecting the vehicle passing the sensor on the lane; a communicating portion having a communication area arranged to substantially correspond to an area on the lane between the first and second sensors for communicating with a communication unit on the vehicle in response to the first sensor to establish a communication link with the communication unit; a timer for measuring a predetermined interval in response to the first sensor; and a microprocessor responsive to the timer, the first and second sensors, and the communicating portion for judging the vehicle as a fair vehicle if the communication link is established during a first interval between when the first sensor detects the vehicle and when the second sensor detects the vehicle and if the communication link is established during a second interval between when the first sensor detects the vehicle and when the first sensor detects that the vehicle has just passed through the first sensor after the predetermined interval and as an unfair vehicle if the communication link is not established during the first interval and if the communication link is not established during the second interval and outputting the judging result.

In the second tolling apparatus, the communication area includes a main communication area and peripheral communication area around the main communication area, an intensity of a radio wave from the communicating portion at the peripheral communication area is lower than that at the main communication area, and the first position is substantially just outside the peripheral communication area.

According to the present invention there is provided a third tolling apparatus which includes: a first sensor arranged at a first position along a lane for detecting a vehicle passing the first sensor on the lane in a direction of the lane; a second sensor arranged at a second position apart from the first sensor by a predetermined distance in the direction for detecting the vehicle passing the second sensor on the lane; a communicating portion having a communication area arranged to substantially correspond to an area on the lane between the first and second sensors for communicating with a communication unit on the vehicle in response to the first sensor to establish a communication link with the communication unit; a microprocessor responsive to the timer, the first and second sensors, and the communicating portion for judging the vehicle as a fair vehicle if the communication link is established during a first interval between when the first sensor detects the vehicle and when the second sensor detects the vehicle and if the communication link is established during a second interval between when the first sensor detects the vehicle and when the first sensor detects another vehicle following the vehicle and as an unfair vehicle if the communication link is not established during the first interval and if the communication link is not established during the second interval and outputting the judging result.

In the third tolling apparatus, the communication area may include a main communication area and peripheral communication area around the main communication area, an intensity of a radio wave from the communicating portion at the peripheral communication area is lower than that at the main communication area and the first position may be substantially just outside the peripheral communication area.

According to the present invention there is provided a fourth tolling apparatus which includes: a first sensor arranged at a first position along a lane for detecting a vehicle passing the first sensor on the lane in a direction of the lane; a second sensor arranged at a second position apart from the first sensor by a predetermined distance in the direction for detecting the vehicle passing the second sensor on the lane; a third sensor arranged between the first and second positions for detecting the vehicle passing the third sensor on the lane; a communicating portion having a communication area arranged to substantially correspond to an area on the lane between the first and second sensors for communicating with a communication unit on the vehicle in response to the first sensor to establish a communication link with the communication unit; a timer for measuring a predetermined interval in response to the first sensor; a microprocessor responsive to the timer, the first and second sensors, and the communicating portion for judging the vehicle as a fair vehicle if the communication link is established during a first interval between when the first sensor detects the vehicle and the second sensor detects the vehicle and if the communication link is established during a second interval between when the first sensor detects the vehicle and when the third sensor detects the vehicle after the predetermined interval and as an unfair vehicle if the communication link is not established during the first interval and if the communication link is not established during the second interval and outputting the judging result.

In the fourth tolling apparatus, an interval between the first position and the third sensor is substantially less than a size of the vehicle in the direction.

According to the present invention there is provided a fifth tolling apparatus which includes: a sensor arranged at a predetermined position along a lane for detecting a vehicle passing the sensor on the lane in a direction of the lane; a communicating portion having a predetermined communication area on the lane extending from the sensor in the direction for communicating with a communication unit on the vehicle in response to the sensor to establish a communication link with the communication unit; a timer for measuring a predetermined interval in response to the sensor; a microprocessor responsive to the timer, the sensor, and the communicating portion for judging the vehicle as a fair vehicle if the communication link is established during the predetermined interval and outputting the judging result.

According to the present invention there is provided a sixth tolling apparatus which includes: a sensor arranged at a predetermined position along a lane for detecting a vehicle passing the sensor on the lane in a direction of the lane; a communicating portion having a predetermined communication area on the lane extending from the sensor in the direction for communicating with a communication unit on the vehicle in response to the sensor to establish a communication link with the communication unit; and a microprocessor responsive to the sensor and the communicating portion for judging the vehicle as a fair vehicle if the communication link is established during an interval between when the sensor detects the vehicle and when the sensor detects that the vehicle has just passed through the sensor and outputting the judging result.

According to the present invention there is provided a seventh tolling apparatus which includes: a sensor arranged at a predetermined position along a lane for detecting a vehicle passing the sensor on the lane in a direction of the lane; a communicating portion having a predetermined communication area on the lane extending from the sensor in the direction for communicating with a communication unit on the vehicle in response to the sensor to establish a communication link with the communication unit; and a microprocessor responsive to the sensor and the communicating portion for judging the vehicle as a fair vehicle if the communication link is established during an interval between when the sensor detects the vehicle and when the sensor detects another vehicle following the vehicle and outputting the judging result.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

<First Embodiment>

Figure 1:
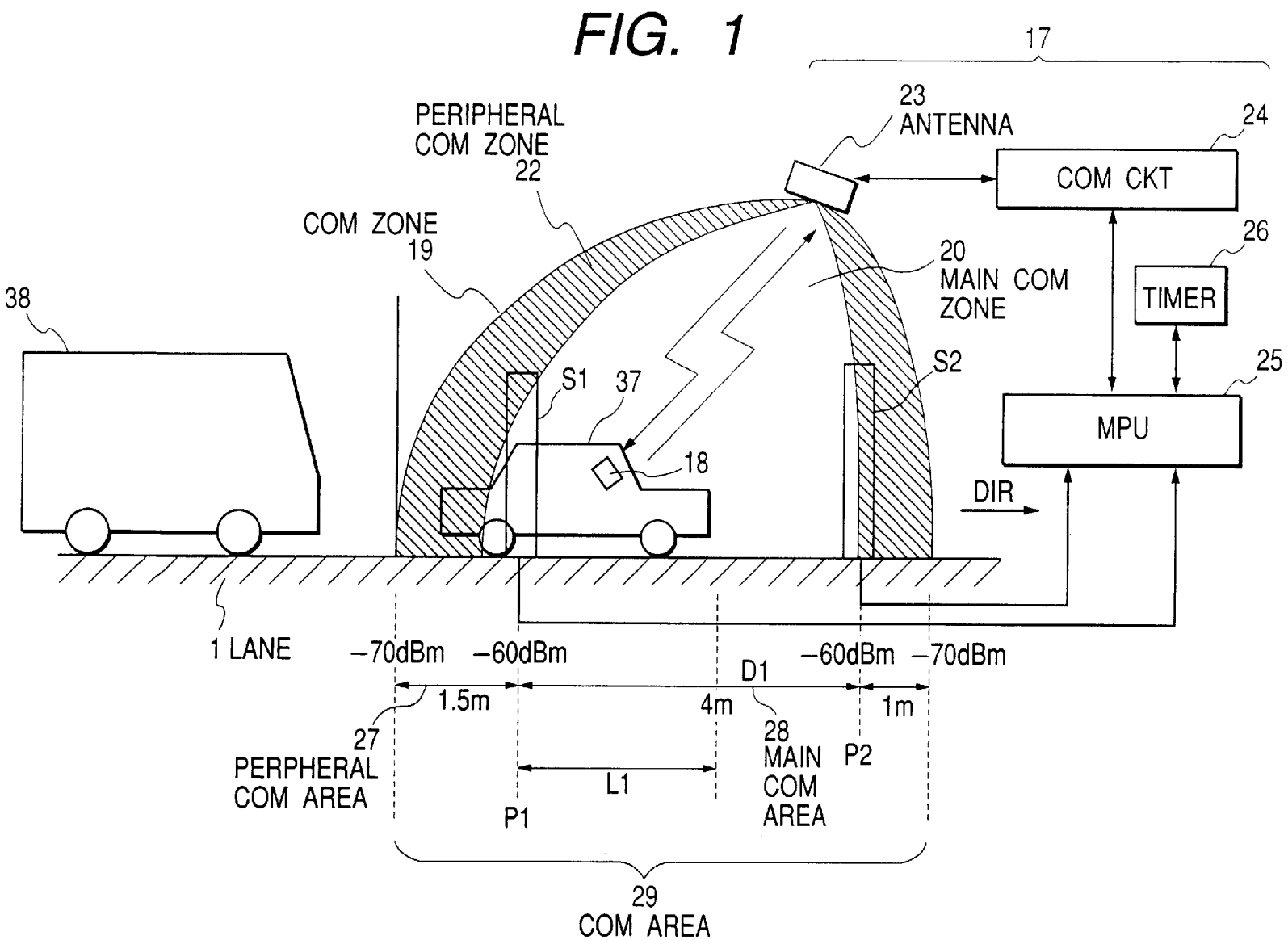
FIG. 1 is a block diagram of a tolling apparatus of a first embodiment of this invention, wherein a side view of a site of the tolling apparatus is also shown.
Figure 2:
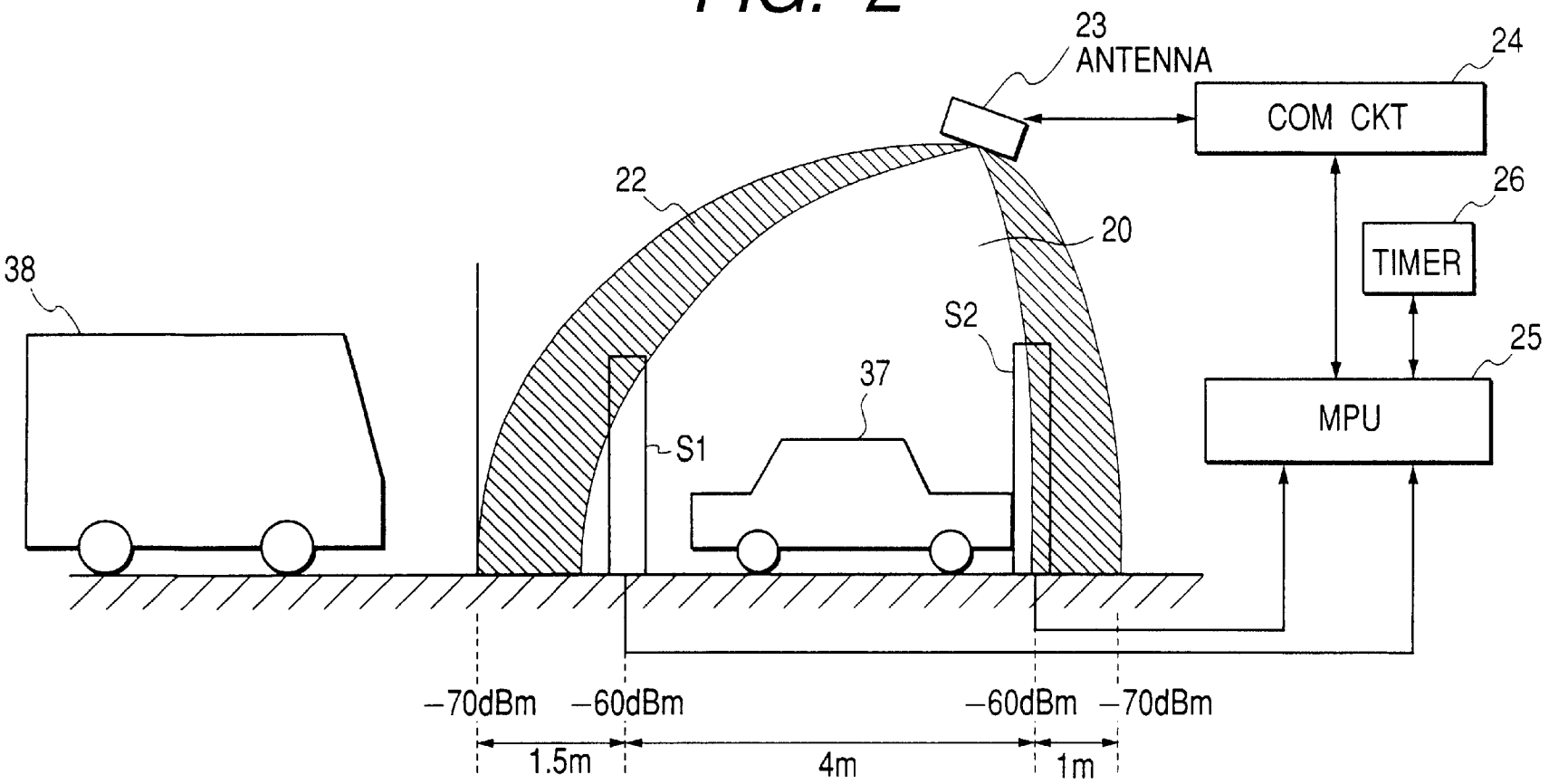
FIG. 2 is a side view of a site of the tolling apparatus of the first embodiment in another condition.

FIG. 1 is a block diagram of a tolling apparatus of a first embodiment of this invention, wherein a side view of a site of the tolling apparatus is also shown. FIG. 2 is a side view of the site of the tolling apparatus in another condition.

The tolling apparatus of the first embodiment includes a first sensor s1 arranged at a first position p1 along a lane 1 for detecting a vehicle 37 passing the first sensor s1 on the lane 1 in a direction DIR, a second sensor s2 arranged at a second position p2 apart from the first sensor s1 by a predetermined distance D1 in the direction DIR for detecting the vehicle 37 passing the second sensor s2 on the lane 1 in the direction DIR, a communicating portion 17, having a peripheral communication area 27 and a main communication area 28 on the lane 1, the main communication area 28 substantially corresponding to an area (p1 to p2) on the lane 1 between the first and second sensors s1 and s2, for communicating with a communication unit 18 on the vehicle 37 in response to the first sensor s1 to establish a communication link with the communication unit 18, a timer 26 for measuring a predetermined interval in response to the first sensor s1, a microprocessor 25 responsive to the timer 26, the first and second sensors s1 and s2, and the communicating portion 17 for judging the vehicle 37 as a fair (ETC, Electronic Toll Collection) vehicle if the communication link is established when the second sensor s2 detects the vehicle 37 and if the communication link is established during the predetermined interval. The microprocessor 25 further judges the vehicle 35 as an unfair (non-ETC) vehicle in response to the first sensor s1 if the communication link is not established when the second sensor s2 detects the vehicle 37 and if the communication link is not established during the predetermined interval and outputs the judging result. The communicating portion 17 includes a communication circuit 24 and an antenna 23 arranged above the lane 1 supported by a gantry (not shown) for transmitting a radio wave signal toward the lane 1 and receives a radio wave signal from a communication unit 18 entering the communication area 29.

The tolling apparatus of this invention is provided to prevent establishment of communication link with one vehicle and with the following vehicle at the same time due to two vehicles existing at the same communication area 29. Therefore, if the vehicle 37 travels at a relatively high speed, for example, more than 30 Km/h, the microprocessor 25 judges establishment of the communication link between the communication portion 17 and the communication unit 18 on the vehicle 37 when the second sensor s2 detects the vehicle 37 (a front of the vehicle 37) as shown in FIG. 2 because a distance between the vehicle 37 and the vehicle 38 is relatively large due to the high speed. On the other hand, if the vehicle 37 travels at a relatively low speed, for example, less than 30 Km/h, the distance between the vehicle 37 and the vehicle 38 is short, so that there is a possibility that the distance between the vehicles 37 and 38 is short. In addition, the antenna 23 has a communication zone 19 including a main communication zone 20 and a peripheral communication zone 22 around the main communication zone 20. The main communication zone 20 provides the main communication area 28 on the lane 1 which corresponds to the area between the first and the second sensor s1 and s2. On the other hand, the peripheral communication zone provides the peripheral communication area 27 before the sensor s1, so that a communication unit (not shown) on the vehicle 38 at the peripheral communication area 27 may communicate with the communication portion 17 or may not communicate with the communication portion 17 because an intensity of the radio wave from the antenna 23 is lower than that at the main communication area 28. If the communication unit on the vehicle 38 can communicate with the communication portion 17 at the peripheral communication area 27, both vehicles 37 and 38 may communicate with the communication portion 17 at the same time. To prevent this, the microprocessor 25 judges establishment of the communication link between the communication portion 17 and the communication unit 18 on the vehicle 37 during the predetermined interval measured by the timer 26 from when the first sensor s1 detects the vehicle 37. In this case, the vehicle 37 travels at a low speed, so that the vehicle 37 advances a short distance of the predetermined interval. This prevents the following vehicle 38 from entering the communication main area 28 and the peripheral communication area 27. The predetermined interval is determined to provide a sufficient time interval for establishing the communication link. Generally, the predetermined interval is twice or three times the time interval for establishing the communication link, for example 500 ms, which corresponds (slightly longer) to the interval (482 ms) necessary for travelling p1 to p2 at 30 Km/h. The predetermined interval is longer than the interval that the vehicle travels from the p1 to p2 at a relatively high speed, so that if the speed of the vehicle 35 is high (more than 30 Km/h), the communication link is judged in response to the second sensor s2. That is, if the speed of the vehicle is high, establishment of the communication is judged in response to the second sensor s2 and if the speed of the vehicle 37 is low, establishment of the communication is judged in response to the timer 26.

When the vehicle 37 enters the communication area 29, in response to the microprocessor 25 and the first sensor s1, the communication portion 17 starts communication with the communication unit 18 on the vehicle 37, that is, the communication portion 17 transmits a radio wave including response requesting data. Then, in response to this, the communication unit 18 on the vehicle 37 transmits a radio wave signal including response data for judging that the communication unit 18 on the vehicle 37 has a right to travel the toll road, such as identification data and vehicle type data. Then, the communication portion 17 receives the response data. When the communication portion 17 receives sufficient data, the communication link with the communication unit 18 is established, so that the communication portion 17 sends communication link establishment data to the microprocessor 25 and holds the communication link establishment data until the microprocessor 25 informs completion of judging the establishment of communication link, i.e., until the microprocessor is informed of detection by the sensor s2.

Figure 3:
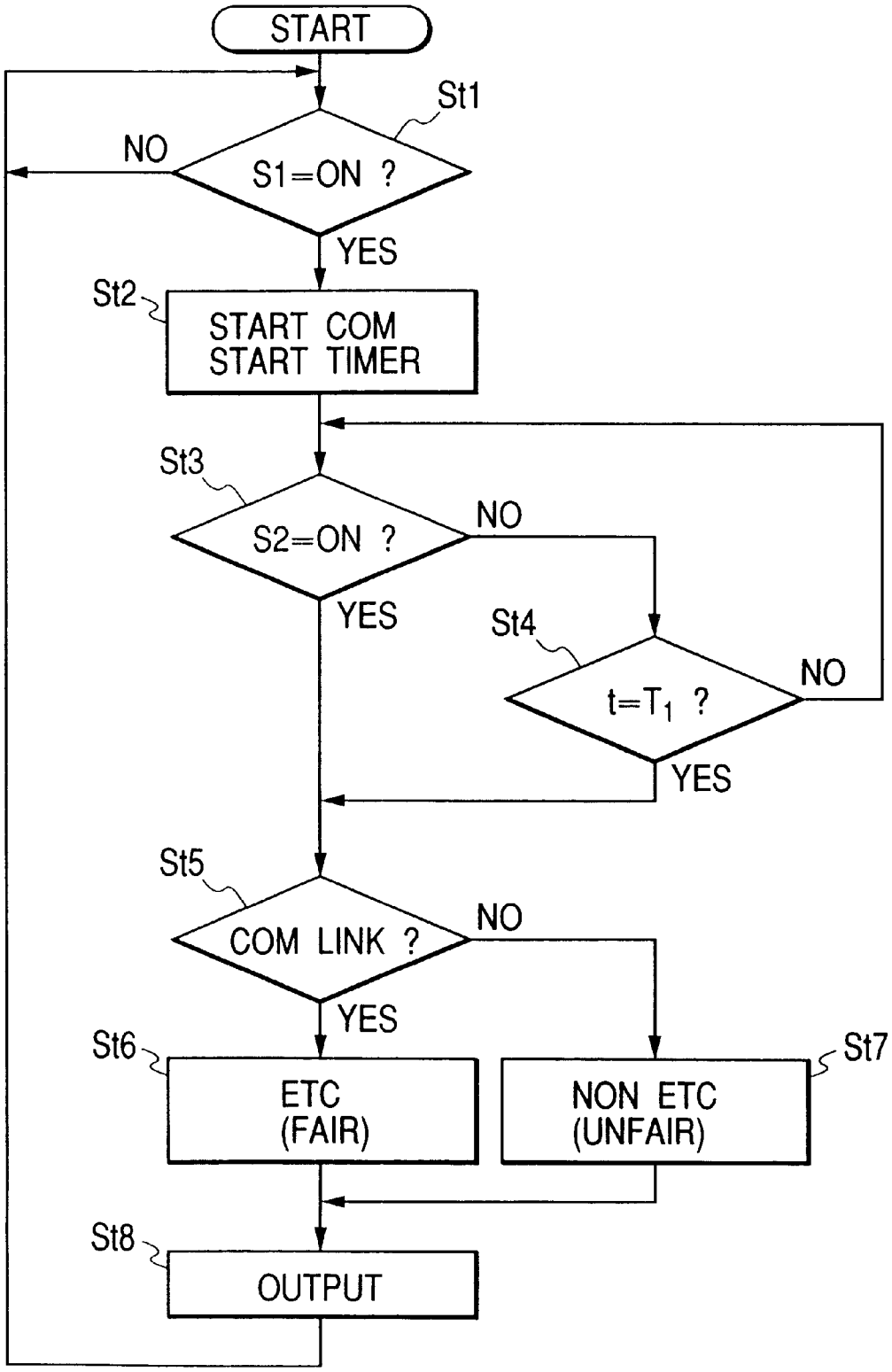
FIG. 3 depicts a flow chart of the first embodiment showing an operation of the microprocessor shown in FIG. 1.

FIG. 3 depicts a flow chart of the first embodiment showing an operation of the microprocessor 25.

The microprocessor 25 checks whether the first sensor s1 detects the vehicle 37 in step st1. If the first sensor s1 detects the vehicle 37 in step st1, the microprocessor 25 operates the communication portion 17 to start communication with the communication unit 18 on the vehicle 37 and starts the timer 26 in step st2. In the following step st3, the microprocessor 25 checks whether the second sensor s2 detects the vehicle 37. If the second sensor s2 detects the vehicle 37, processing proceeds to step st5 and if the second sensor s2 does not detect the vehicle 37, processing proceeds to step st4. In step st4, the microprocessor 25 checks whether the time t measured by the timer 26 reaches the predetermined interval T1. If the time t measured by the timer 26 does not reach the predetermined interval T1, processing returns to step st3. If the time t measured by the timer 26 reaches the predetermined interval T1, processing proceeds to step st5. In step st5, the microprocessor 25 checks whether the communication link has been (is) established by checking the communication portion 17. If the communication link has been (is) established, the microprocessor 25 judges the vehicle 37 as a fair (ETC) vehicle in step st6 and if the communication link has not been established, the microprocessor 25 judges the vehicle 37 as an unfair (not ETC) vehicle in step st7. Then, the microprocessor 25 outputs the judging result in step st8. When the second sensor s2 detects the vehicle 37, the microprocessor 25 stops the operation of the communication portion 17.

<Second Embodiment>

Figure 4:
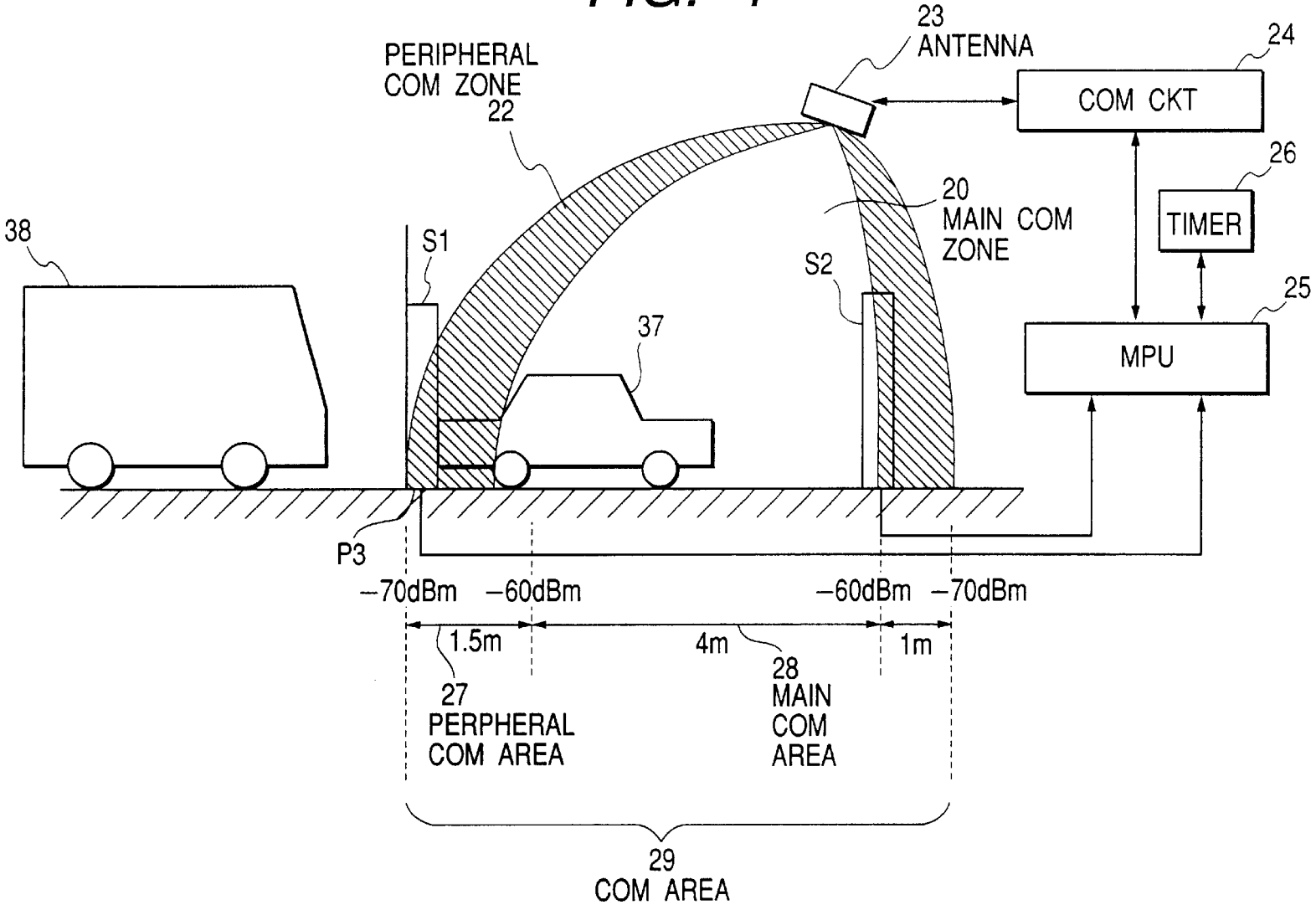
FIG. 4 is a block diagram of a tolling apparatus of a second embodiment of this invention.
Figure 5:
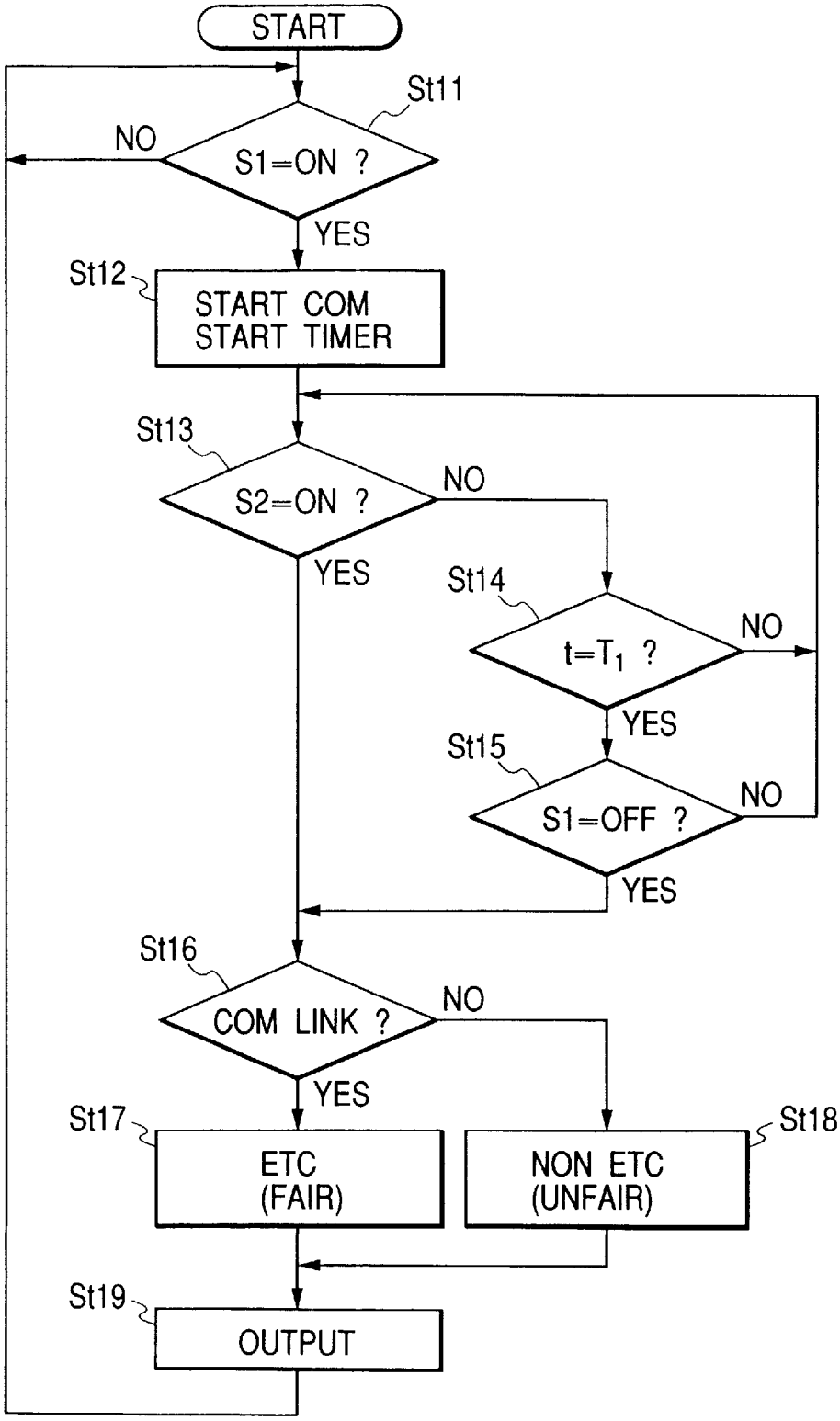
FIG. 5 depicts a flow chart of the second embodiment showing an operation of the microprocessor shown in FIG. 4.

FIG. 4 is a block diagram of a tolling apparatus of a second embodiment of this invention, wherein a side view of a site of the tolling apparatus of the second embodiment is also shown. FIG. 5 depicts a flow chart of the second embodiment showing an operation of the microprocessor.

The tolling apparatus of the second embodiment is substantially the same as that of the first embodiment. The difference is that the microprocessor 25 judges the vehicle as a fair vehicle if the communication link is established during a first interval between when the first sensor s1 detects the vehicle and when the second sensor s2 detects the vehicle and if the communication link is established during a second interval between when the first sensor s1 detects the vehicle (a front of the vehicle) and when the first sensor s1 detects that the vehicle (a tail of the vehicle 37) has just passed through the first sensor s1 after the predetermined interval T1 and judges as an unfair vehicle if the communication link is not established during the first interval and if the communication link is not established during the second interval and outputs the judging result.

The communication area 29 includes the main communication area 28 and the peripheral communication area 27 around the main communication area 28. An intensity of a radio wave from the communicating portion 17 at the peripheral communication area 27 is lower than that at the main communication area 28 and the position p3 of the first sensor s1 is substantially just outside the peripheral communication area 27. Therefore, though the vehicle 37 travels at a relatively low speed, the following vehicle 38 cannot enter the communication area 29 when establishment of communication link is judged.

In FIG. 5, the microprocessor 25 checks whether the first sensor s1 detects the vehicle 37 in step st11. If the first sensor s1 detects the vehicle 37 in step st11, the microprocessor 25 operates the communication portion 17 to start communication with the communication unit 18 on the vehicle 37 and starts the timer 26 in step st12. In the following step st13, the microprocessor 25 checks whether the second sensor s2 detects the vehicle 37. If the second sensor s2 detects the vehicle 37, processing proceeds to step st16 and if the second sensor s2 does not detect the vehicle 37, processing proceeds to step st14. In step st14, the microprocessor 25 checks whether the time t measured by the timer 26 reaches the predetermined interval T1. If the time t measured by the timer 26 does not reach the predetermined interval T1, processing returns to step st13. If the time t measured by the timer 26 reaches T1, the microprocessor 25 checks whether the vehicle 37 has just passed the sensor s1 by checking the output of the sensor s1. If the vehicle 37 has just passed the sensor s1, processing proceeds to step st16 and if the vehicle 37 has not passed the sensor s1, processing returns to step st13.

In step st16, the microprocessor 25 checks whether the communication link has been (is) established by checking the communication portion 17. If the communication link has been (is) established, the microprocessor 25 judges the vehicle 37 as a fair (ETC) vehicle in step st16 and if the communication link has not been established, the microprocessor 25 judges the vehicle 37 as an unfair (not ETC) vehicle in step st7. Then, the microprocessor 25 outputs the judging result in step st19.

<Third Embodiment>

Figure 6:
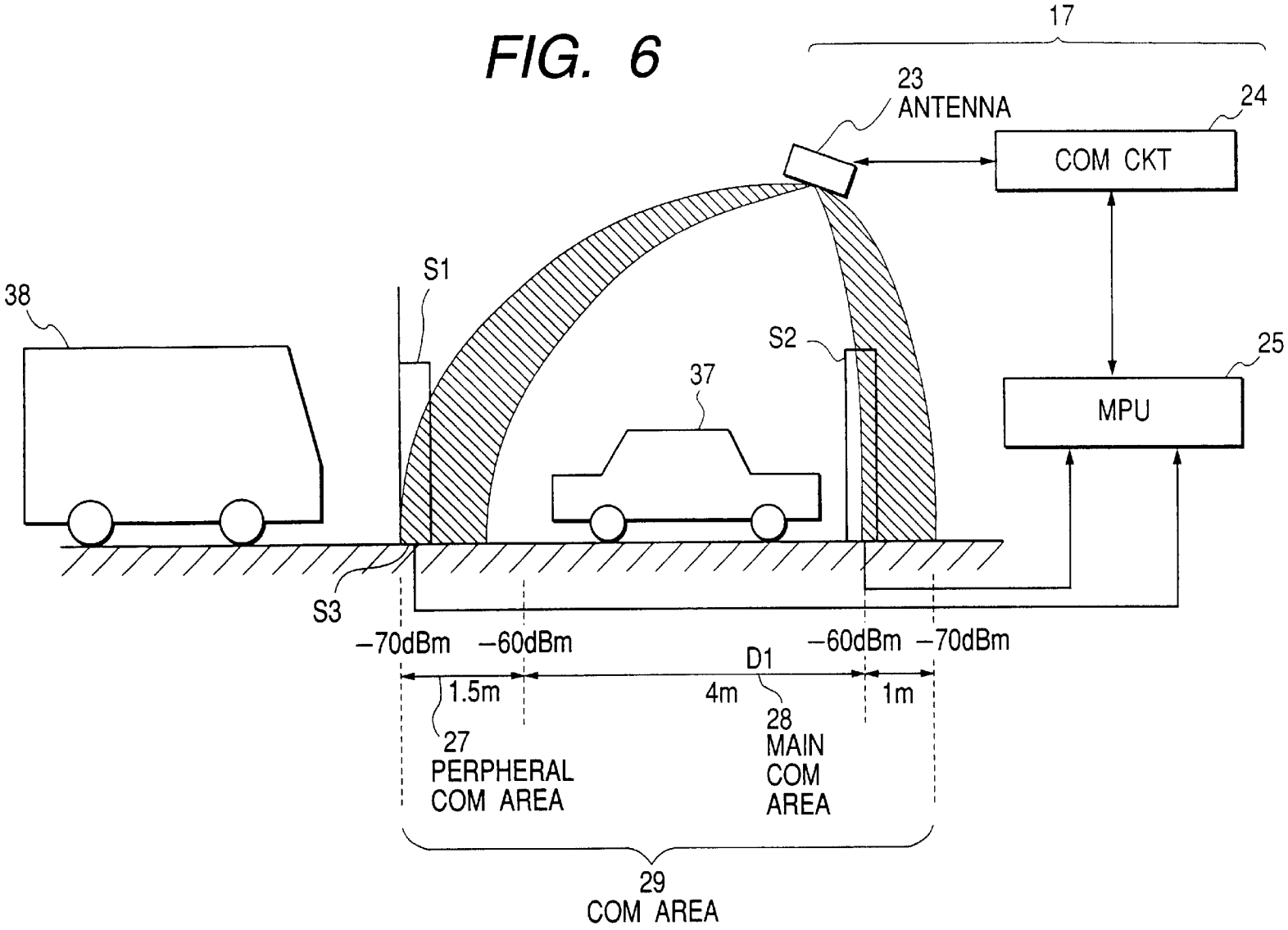
FIG. 6 is a block diagram of a tolling apparatus of a third embodiment of this invention.
Figure 7:
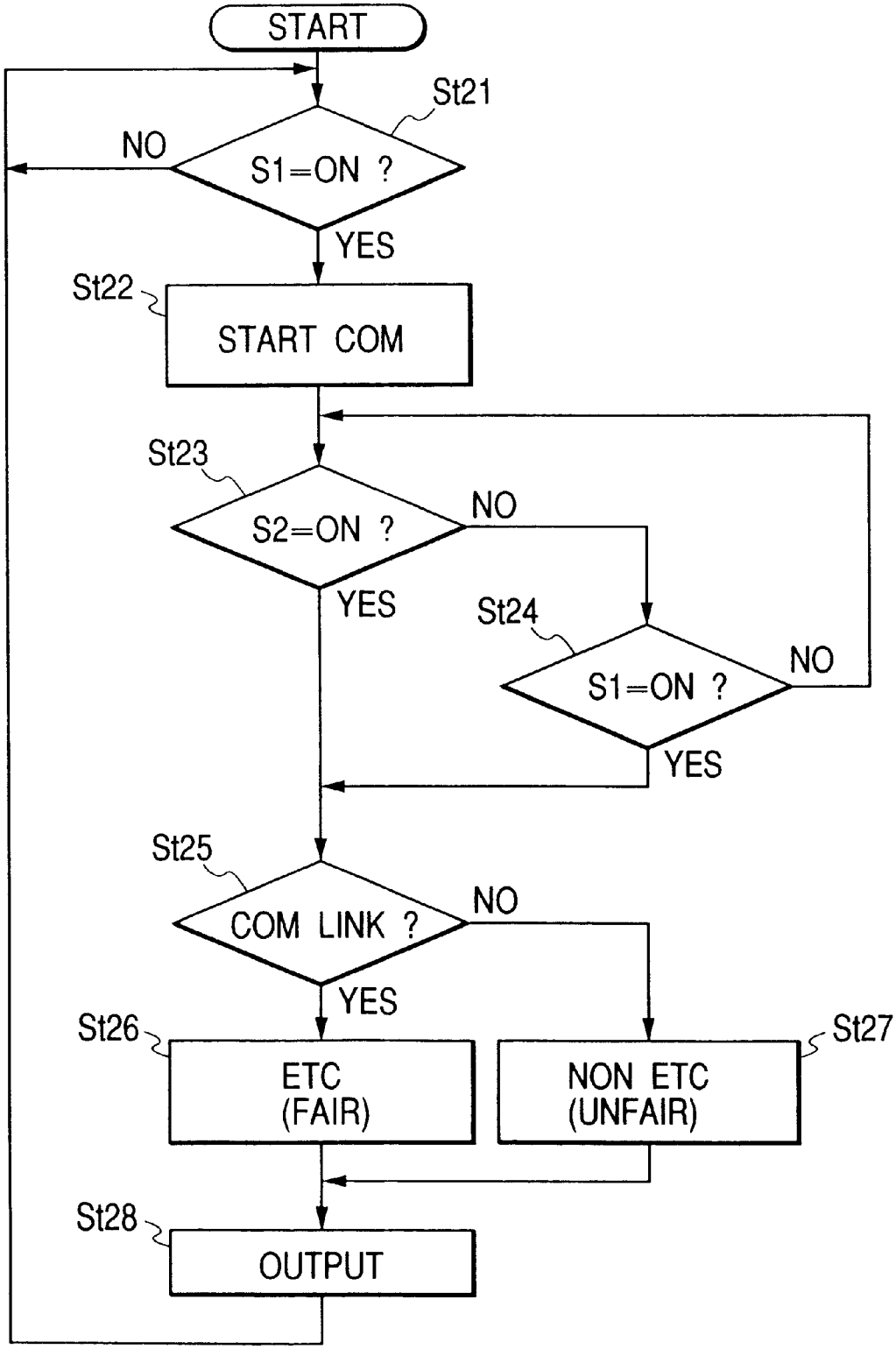
FIG. 7 depicts a flow chart of the third embodiment showing an operation of the microprocessor shown in FIG. 6.

FIG. 6 is a block diagram of a tolling apparatus of a third embodiment of this invention, wherein a side view of a site of the tolling apparatus of the third embodiment is also shown. FIG. 7 depicts a flow chart of the third embodiment showing an operation of the microprocessor 25.

The tolling apparatus of the third embodiment is substantially the same as that of the second embodiment. The difference is that the microprocessor 25 judges the vehicle 37 as a fair vehicle (ETC vehicle) if the communication link is established during the first interval between when the first sensor s1 detects the vehicle 37 and when the second sensor s2 detects the vehicle 37 and if the communication link is established during a third interval between when the first sensor s1 detects the vehicle 37 and when the first sensor s1 detects another vehicle 38 following the vehicle 37 and as an unfair vehicle if the communication link is not established during the first interval and if the communication link is not established during the third interval and outputs the judging result. In addition the timer 26 is omitted.

In the third embodiment, the position p3 of the first sensor s1 is substantially just outside the peripheral communication area 27. Therefore, establishment of the communication link is judged when the vehicle 37 reaches the second sensor s2 or when the following vehicle 38 reaches the first sensor s1. Therefore, though the vehicle 37 travels at a relatively low speed, the communication unit 18 on the following vehicle 38 cannot enter the communication area 29 when establishment of communication link is judged.

In FIG. 7, the microprocessor 25 checks whether the first sensor s1 detects the vehicle 37 in step st21. If the first sensor s1 detects the vehicle 37 in step st21, the microprocessor 25 operates the communication portion 17 to start communication with the communication unit 18 on the vehicle 37 in step st22. In the following step st23, the microprocessor 25 checks whether the second sensor s2 detects the vehicle 37. If the second sensor s2 detects the vehicle 37, processing proceeds to step st25 and if the second sensor s2 does not detect the vehicle 37, processing proceeds to step st24. In step st24, the microprocessor 25 checks whether the vehicle 38 reaches the sensor s1 by checking the output of the sensor s1. If the vehicle 38 reaches the sensor s1, processing proceeds to step st25 and if the vehicle 38 does not reach the sensor s1, processing returns to step st23.

In step st25, the microprocessor 25 checks whether the communication link has been (is) established by checking the communication portion 17. If the communication link has been (is) established, the microprocessor 25 judges the vehicle 37 as a fair (ETC) vehicle in step st26 and if the communication link has not been established, the microprocessor 25 judges the vehicle 37 as an unfair (not ETC) vehicle in step st27. Then, the microprocessor 25 outputs the judging result in step st28.

<Fourth Embodiment>

Figure 8:
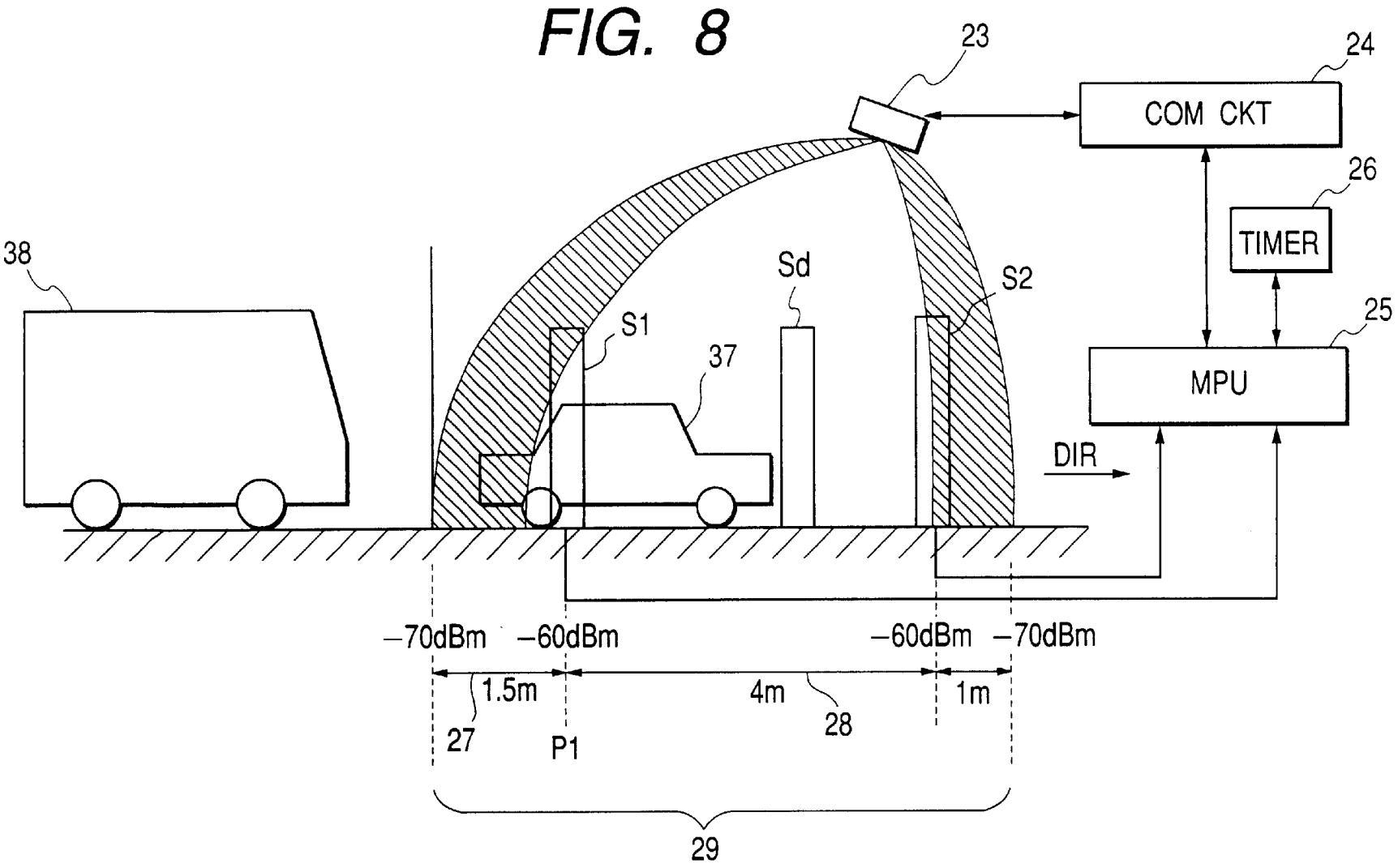
FIG. 8 is a block diagram of a tolling apparatus of a fourth embodiment of this invention.
Figure 9:
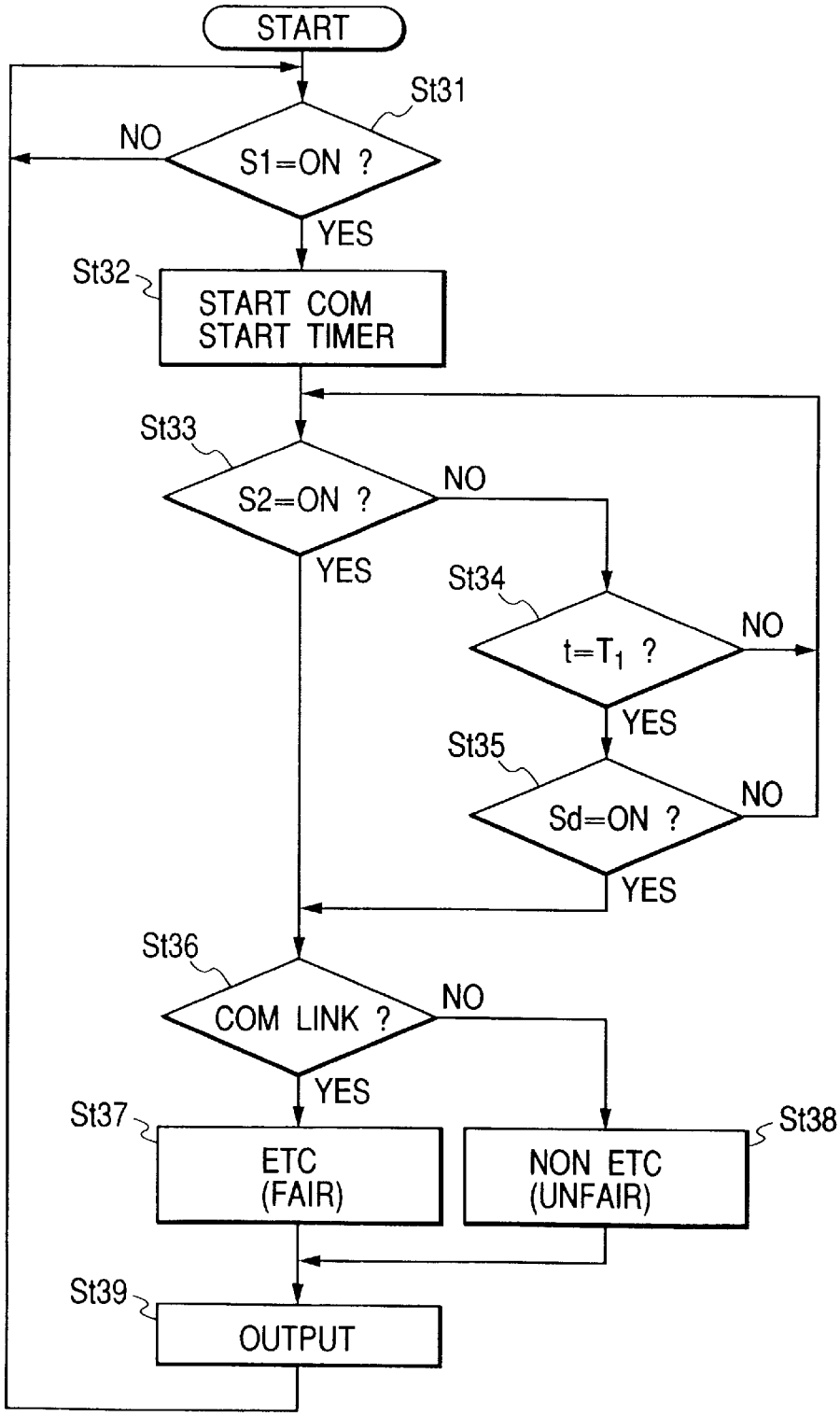
FIG. 9 depicts a flow chart of the fourth embodiment showing an operation of the microprocessor shown in FIG. 8.

FIG. 8 is a block diagram of a tolling apparatus of a fourth embodiment of this invention, wherein a side view of a site of the tolling apparatus of the fourth embodiment is also shown. FIG. 9 depicts a flow chart of the fourth embodiment showing an operation of the microprocessor 25.

The tolling apparatus of the fourth embodiment is substantially the same as that of the first embodiment. The difference is that a third sensor sd is further provided and the microprocessor 25 judges establishment of the communication link in accordance with the third sensor sd in addition to the first and second sensors s1 and s2.

That is, the microprocessor 25 judges the vehicle 37 as a fair vehicle if the communication link is established during the first interval between when the first sensor s1 detects the vehicle 37 and the second sensor s2 detects the vehicle 37 and if the communication link is established during a fourth interval between when the first sensor s1 detects the vehicle 37 and when the third sensor sd detects the vehicle 37 after the predetermined interval measured by the timer 26 responsive to the first sensor s1 and as an unfair vehicle if the communication link is not established during the first interval and if the communication link is not established during the fourth interval and outputs the judging result.

In FIG. 9, the microprocessor 25 checks whether the first sensor s1 detects the vehicle 37 in step st31. If the first sensor s1 detects the vehicle 37 in step st31, the microprocessor 25 operates the communication portion 17 to start communication with the communication unit 18 on the vehicle 37 and starts the timer 26 in step st32. In the following step st33, the microprocessor 25 checks whether the second sensor s2 detects the vehicle 37. If the second sensor s2 detects the vehicle 37, processing proceeds to step st36 and if the second sensor s2 does not detect the vehicle 37, processing proceeds to step st34. In step st34, the microprocessor 25 checks whether the time t measured by the timer 26 reaches the predetermined interval T1. If the time t measured by the timer 26 does not reach the predetermined interval T1, processing returns to step st33. If the time t measured by the timer 26 reaches the predetermined interval T1, the microprocessor 25 checks whether the vehicle 37 reaches the third sensor sd by checking the output of the sensor sd. If the vehicle 37 reaches the third sensor sd, processing proceeds to step st36 and if the vehicle 37 does not reach the third sensor sd, processing returns to step st33.

In step st36, the microprocessor 25 checks whether the communication link has been (is) established by checking the communication portion 17. If the communication link has been (is) established, the microprocessor 25 judges the vehicle 37 as a fair (ETC) vehicle in step st37 and if the communication link has not been established, the microprocessor 25 judges the vehicle 37 as an unfair (not ETC) vehicle in step st38. Then, the microprocessor 25 outputs the judging result in step st39.

A distance between the first position P1 and the third sensor sd is substantially less than a size of the vehicle 37 in the direction DIR, so that though the speed of the vehicle 37 is relative low, the communication unit 18 on the following vehicle 38 cannot enter the communication area 29.

In the above mentioned embodiments, the communication circuit 24 holds the data indicative of the establishment of the communication link from when the communication circuit 24 detects establishment of the communication link to when the microprocessor 25 finally judges the establishment of the communication link. However, the microprocessor 25 may finally judges the establishment of the communication link instantaneously.

Figure 10:
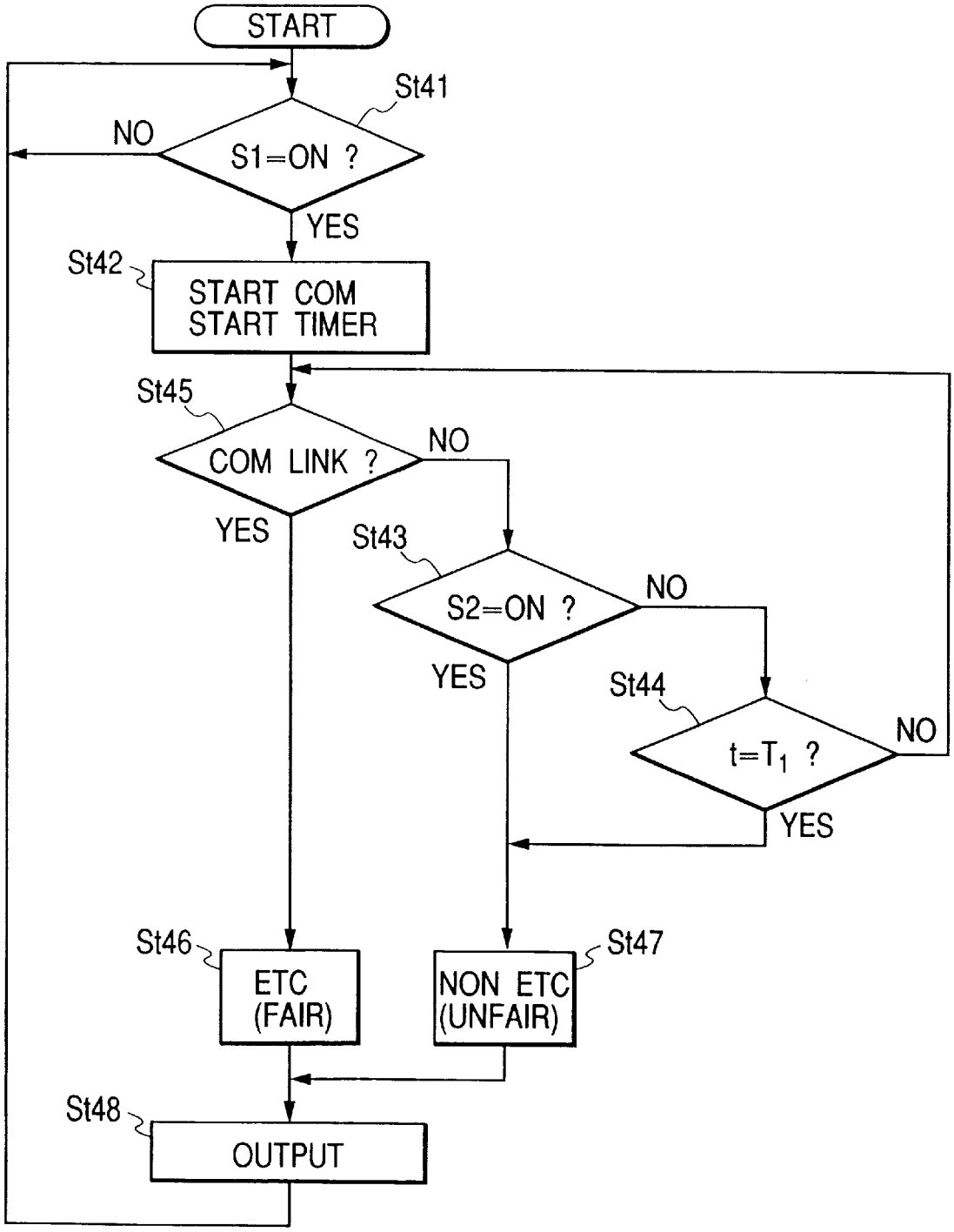
FIG. 10 depicts a flow chart of modification showing an operation of the microprocessor shown in FIG. 1.

FIG. 10 depicts a flow chart of modification showing an operation of the microprocessor 25.

The structure of the modification is substantially the same as that of the first to fourth embodiments.

The difference is that the microprocessor finally judges the establishment of the communication link from when the microprocessor 25 operates the communication portion 17 to start communication.

In FIG. 10, the microprocessor 25 checks whether the first sensor s1 detects the vehicle 37 in step st41. If the first sensor s1 detects the vehicle 37 in step st41, the microprocessor 25 operates the communication portion 17 to start communication with the communication unit 18 on the vehicle 37 and starts the timer 26 in step st42. In the following step st45, the microprocessor 25 checks whether the communication link is established by checking the communication portion 17. If the communication link is established, the microprocessor 25 judges the vehicle 37 as a fair (ETC) vehicle in step st46.

If the communication link is not established in step st45, the microprocessor 25 checks whether the second sensor s2 detects the vehicle 37 in step st43. If the second sensor s2 detects the vehicle 37, processing proceeds to step st47, where the microprocessor 25 judges the vehicle 37 as an unfair vehicle and if the second sensor s2 does not detect the vehicle 37, processing proceeds to step st44. In step st44, the microprocessor 25 checks whether the time t measured by the timer 26 reaches the predetermined interval T1. If the time t measured by the timer does not reach the predetermined interval T1, processing returns to step st45. If the time t measured by the timer 26 reaches the predetermined interval T1, processing proceeds to step st47. In step st47, the microprocessor 25 judges the vehicle 37 as an unfair (not ETC) vehicle in step st47. Then, the microprocessor 25 outputs the judging result in step st48. This modification corresponds to the first embodiment which uses the outputs of the first and second sensors s1 and s2 and the timer 26. However, this modification is applicable to modify second to fourth embodiments to provide instantaneous judgement of the communication link.

What is claimed is:

1. A tolling apparatus comprising:

first detecting means arranged at a first position along a lane for detecting a vehicle passing said first detecting means on said lane in a direction of said lane;

second detecting means arranged at a second position apart from said first detecting means by a predetermined distance in said direction for detecting said vehicle passing said second detecting means on said lane;

communicating means having a communication area on said lane arranged to substantially correspond to an area on said lane between said first and second detecting means for communicating with a communication unit on said vehicle in response to said first detecting means to establish a communication link with said communication unit;

time measuring means for measuring a predetermined interval in response to said first detecting means;

judging means responsive to said time measuring means, said first and second detecting means, and said communicating means for judging said vehicle as a fair vehicle if said communication link is established during an interval between when said first detecting means detects said vehicle and when said second detecting means detects said vehicle and if said communication link is established during said predetermined interval and as an unfair vehicle if said communication link is not established during said interval and if said communication link is not established during said predetermined interval and outputting the judging result.

2. A tolling apparatus comprising:

first detecting means arranged at a first position along a lane for detecting a vehicle passing said first detecting means on said lane in a direction of said lane;

second detecting means arranged at a second position apart from said first detecting means by a predetermined distance in said direction for detecting said vehicle passing said detecting means on said lane;

communicating means having a communication area arranged to substantially correspond to an area on said lane between said first and second detecting means for communicating with a communication unit on said vehicle in response to said first detecting means to establish a communication link with said communication unit;

time measuring means for measuring a predetermined interval in response to said first detecting means; and judging means responsive to said time measuring means, said first and second-detecting means, and said communicating means for judging said vehicle as a fair vehicle if said communication link is established during a first interval between when said first detecting means detects said vehicle and when said second detecting means detects said vehicle and if said communication link is established during a second interval between when said first detecting means detects said vehicle and when said first detecting means detects that said vehicle has just passed through said first detecting means after said predetermined interval and as an unfair vehicle if said communication link is not established during said first interval and if said communication link is not established during said second interval and outputting the judging result.

3. A tolling apparatus as claimed in claim 2, wherein said communication area including a main communication area and peripheral communication area around said main communication area, an intensity of a radio wave from said communicating means at said peripheral communication area is lower than that at said main communication area and said first position is substantially just outside said peripheral communication area.

4. A tolling apparatus comprising:

first detecting means arranged at a first position along a lane for detecting a vehicle passing said first detecting means on said lane in a direction of said lane;

second detecting means arranged at a second position apart from said first detecting means by a predetermined distance in said direction for detecting said vehicle passing said second detecting means on said lane;

communicating means having a communication area arranged to substantially correspond to an area on said lane between said first and second detecting means for communicating with a communication unit on said vehicle in response to said first detecting means to establish a communication link with said communication unit;

judging means responsive to said time measuring means, said first and second detecting means, and said communicating means for judging said vehicle as a fair vehicle if said communication link is established during a first interval between when said first detecting means detects said vehicle and when said second detecting means detects said vehicle and if said communication link is established during a second interval between when said first detecting means detects said vehicle and when said first detecting means detects another vehicle following said vehicle and as an unfair vehicle if said communication link is not established during said first interval and if said communication link is not established during said second interval and outputting the judging result.

5. A tolling apparatus as claimed in claim 4, wherein said communication area includes a main communication area and peripheral communication area around said main communication area, an intensity of a radio wave from said communicating means at said peripheral communication area is lower than that at said main communication area and said first position is substantially just outside said peripheral communication area.

6. A tolling apparatus comprising:

first detecting means arranged at a first position along a lane for detecting a vehicle passing said first detecting means on said lane in a direction of said lane;

second detecting means arranged at a second position apart from said first detecting means by a predetermined distance in said direction for detecting said vehicle passing said second detecting means on said lane;

third detecting means arranged between said first and second positions for detecting said vehicle passing said third detecting means on said lane;

communicating means having a communication area arranged to substantially correspond to an area on said lane between said first and second detecting means for communicating with a communication unit on said vehicle in response to said first detecting means to establish a communication link with said communication unit;

time measuring means for measuring a predetermined interval in response to said first detecting means;

judging means responsive to said time measuring means, said first and second detecting means, and said communicating means for judging said vehicle as a fair vehicle if said communication link is established during a first interval between when said first detecting means detects said vehicle and said second detecting means detects said vehicle and if said communication link is established during a second interval between when said first detecting means detects said vehicle and when said third detecting means detects said vehicle after said predetermined interval and as an unfair vehicle if said communication link is not established during said first interval and if said communication link is not established during said second interval and outputting the judging result.

7. A tolling apparatus as claimed in claim 6, wherein an interval between said first position and said third detecting means is substantially less than a size of said vehicle in said direction.

8. A tolling apparatus comprising:

detecting means arranged at a predetermined position along a lane for detecting a vehicle passing said detecting means on said lane in a direction of said lane;

communicating means having a predetermined communication area on said lane extending from said detecting means in said direction for communicating with a communication unit on said vehicle in response to said detecting means to establish a communication link with said communication unit;

time measuring means for measuring a predetermined interval in response to said detecting means;

judging means responsive to said time measuring means, said detecting means, and said communicating means for judging said vehicle as a fair vehicle if said communication link is established during said predetermined interval and outputting the judging result.

9. A tolling apparatus comprising:

detecting means arranged at a predetermined position along a lane for detecting a vehicle passing said detecting means on said lane in a direction of said lane;

communicating means having a predetermined communication area on said lane extending from said detecting means in said direction for communicating with a communication unit on said vehicle in response to said detecting means to establish a communication link with said communication unit; and judging means responsive to said detecting means and said communicating means for judging said vehicle as a fair vehicle if said communication link is established during an interval between when said detecting means detects said vehicle and when said detecting means detects that said vehicle has just passed through said detecting means and outputting the judging result.

10. A tolling apparatus comprising:

detecting means arranged at a predetermined position along a lane for detecting a vehicle passing said detecting means on said lane in a direction of said lane;

communicating means having a predetermined communication area on said lane extending from said detecting means in said direction for communicating with a communication unit on said vehicle in response to said detecting means to establish a communication link with said communication unit; and judging means responsive to said detecting means and said communicating means for judging said vehicle as a fair vehicle if said communication link is established during an interval between when said detecting means detects said vehicle and when said detecting means detects another vehicle following said vehicle and outputting the judging result.

* * * * *